US010172460B2

(12) United States Patent
Gasser

(10) Patent No.: US 10,172,460 B2
(45) Date of Patent: Jan. 8, 2019

(54) RETRACTING DEVICE FOR FURNITURE PARTS

(71) Applicant: Julius Blum GmbH, Hoechst (AT)

(72) Inventor: Ingo Gasser, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/470,210

(22) Filed: Mar. 27, 2017

(65) Prior Publication Data

US 2017/0196356 A1 Jul. 13, 2017

Related U.S. Application Data

(63) Continuation of application No. PCT/AT2015/000123, filed on Sep. 28, 2015.

(30) Foreign Application Priority Data

Oct. 30, 2014 (AT) ..... A 797/2014

(51) Int. Cl.
*A47B 88/467* (2017.01)
*E05F 1/16* (2006.01)

(52) U.S. Cl.
CPC ..... *A47B 88/467* (2017.01); *E05F 1/16* (2013.01)

(58) Field of Classification Search
CPC ..... A47B 88/467; A47B 88/047; A47B 88/49; A47B 88/0481; A47B 88/46;
(Continued)

(56) References Cited

U.S. PATENT DOCUMENTS 5,020,868 A * 6/1991 Brunnert ..... A47B 88/467 16/80
8,905,498 B2 * 12/2014 Hammerle ..... A47B 88/047 312/319.1

(Continued)

FOREIGN PATENT DOCUMENTS

CN 101297721 11/2008
CN 102245054 11/2011

(Continued)

OTHER PUBLICATIONS

International Search Report dated Dec. 22, 2015 in International (PCT) Application No. PCT/AT2015/000123.

(Continued)

*Primary Examiner* — Hiwot E Tefera
(74) *Attorney, Agent, or Firm* — Wenderoth, Lind & Ponack, L.L.P.

(57) ABSTRACT

A retraction device includes an entrainment member to be releasably coupled to a movable furniture part and supported displaceably along a linear displacement path, a spring device for applying a force to the entrainment member, the spring device configured to be tensioned by a spring holder separate from the entrainment member, and a coupling device for motionally coupling a movement between the entrainment member and the spring holder. The fastening location of the spring device on the spring holder falls back relative to the position of the entrainment member along a control curve by the coupling device as the entrainment member is being pulled out in an opening direction. The coupling device includes a two-armed lever pivotally mounted about a pivoting axis on the spring holder. A first lever end of the two-armed lever is motionally coupled to the entrainment member and the second lever end includes a guide element.

14 Claims, 6 Drawing Sheets

(58) Field of Classification Search
CPC ..... A47B 2088/4675; A47B 88/47; A47B 2210/0054; A47B 2210/0018; E05F 1/16
USPC ..... 312/333, 319.1, 334.8, 334.7
See application file for complete search history.

(56) References Cited

U.S. PATENT DOCUMENTS

| | | | | |
|---|---|---|---|---|
| 9,702,613 | B2 * | 7/2017 | Yoo | F25D 25/025 |
| 2008/0265732 | A1 | 10/2008 | Weber | |
| 2011/0175508 | A1 * | 7/2011 | Rechberg | E05F 3/108 312/334.8 |
| 2013/0088132 | A1 * | 4/2013 | Hammerle | A47B 88/047 312/319.1 |
| 2014/0346941 | A1 * | 11/2014 | Gasser | A47B 88/04 312/334.1 |
| 2015/0047149 | A1 | 2/2015 | Muller et al. | |
| 2015/0108891 | A1 | 4/2015 | Brunnmayr | |
| 2015/0374123 | A1 * | 12/2015 | Goetz | E05B 65/462 312/319.1 |
| 2016/0150880 | A1 * | 6/2016 | Chen | A47B 88/047 312/319.1 |
| 2016/0296015 | A1 * | 10/2016 | Zhu | A47B 88/047 |
| 2017/0284730 | A1 * | 10/2017 | Yoo | F25D 25/025 |
| 2018/0055225 | A1 * | 3/2018 | Chen | A47B 88/49 |

FOREIGN PATENT DOCUMENTS

| | | |
|---|---|---|
| CN | 102781278 | 11/2012 |
| CN | 103261554 | 8/2013 |
| CN | 203524176 | 4/2014 |
| DE | 39 42 518 | 7/1990 |
| DE | 10 2010 036 902 | 2/2011 |
| DE | 10 2010 061 160 | 6/2012 |
| JP | 8-38281 | 2/1996 |
| JP | 2006-320495 | 11/2006 |
| WO | 2007/111424 | 10/2007 |
| WO | 2011/150432 | 12/2011 |
| WO | 2013/138826 | 9/2013 |

OTHER PUBLICATIONS

Search Report dated Jul. 17, 2015 in Austrian Application No. A 797/2014, with English translation.
English translation of Search Report issued with Office Action dated Aug. 3, 2018 in Chinese Application No. 201580056896.8.

* cited by examiner

RETRACTING DEVICE FOR FURNITURE PARTS

BACKGROUND OF THE INVENTION

The present invention relates to a retraction device for retracting a movably supported furniture part into the closed position relative to a furniture carcass. The retraction device includes an entrainment member which can be releasably coupled to the movable furniture part and which is supported displaceably at least over a region along a linear displacement path. A spring device is provided for applying a force to the entrainment member, and the spring device can be tensioned by a spring holder which is separate from the entrainment member. A coupling device motionally couples a movement between the entrainment member and the spring holder, and, due to the coupling device, the fastening location of the spring device on the spring holder falls back relative to the position of the entrainment member along a control curve as the entrainment member is being pulled out in an opening direction.

The invention further relates to a drawer pull-out guide with a retraction device of the type to be described and further to an arrangement having a drawer and such a retraction device.

Retraction devices are used, in particular, with drawers or sliding doors which are freely displaceable over a large region of their extension path and which can be engaged by the entrainment member of the retraction device at the end of the closing movement and which are then pulled by a spring force into the closed end position and are being held in this position with a predetermined spring force. When the movable furniture part is being opened, an operator firstly has to apply a pulling force against the spring resistance of the retraction device, until the entrainment member is uncoupled from the movable furniture part after a predetermined distance and is then being moved into a pre-stressed parking position in which the spring remains in a tensioned ready position so that in the next closing process, the movable furniture part can be pulled in again. For an operator, uncoupling of the entrainment member in the opening movement of the drawer frequently makes itself noticeable with a jerky movement and with a clicking noise. Because of the sudden spring separation force, the drawer is freely movable and is accelerated towards the opening direction by virtue of the previously exerted pulling force.

WO 2011/150432 A1 solves the above problem by providing a spring holder separate from the entrainment member, and the spring holder is displaceably guided along a control curve. The entrainment member and the spring holder are thereby motionally coupled together by a coupling device in the form of interengaging toothings. Upon tensioning the spring device (i.e. when the movable furniture part is being opened), the fastening location of the spring device on the spring holder falls back relative to the position of the entrainment member which is moved towards the opening direction. Therefore, the movement of the fastening location of the spring device is slower than the movement of the entrainment member. The charging of the spring device is thereby effected with reduced effort, and the undesired spring separation force and an unduly large acceleration of the movable furniture part related therewith can be avoided when the movable furniture part is decoupled from the entrainment member.

SUMMARY OF THE INVENTION

It is an object of the present invention to provide a retraction device of the aforementioned type having reduced frictional forces and a more compact structure.

According to the invention, it is thus provided that the coupling device includes at least one two-armed lever having two lever ends. The two-armed lever is pivotally mounted about a pivoting axis on the spring holder, a first lever end of the two-armed lever is motionally coupled to the entrainment member, and the second lever end of the two-armed lever includes at least one guide element. Upon pulling out the entrainment member, the guide element is displaceably guided at least over a region along the control curve.

Due to the coupling device with the two-armed lever, a lever transmission with a force reducing mechanism can be provided which has reduced frictional forces and reduced noise emissions in comparison with a gear transmission. In addition to simple manufactured components, the proposed construction also offers the possibility to nest the levers of the coupling device, in particular in the retracted position of the entrainment member, into one another, whereby a very compact structure of the retraction device can be realized. By way of the respective form and size of the two-armed lever and the control curve, respectively, the required forces for tensioning the spring device as well as the effective length of the tensioning path can be modified in various configurations.

BRIEF DESCRIPTION OF THE DRAWINGS

Further details and advantages of the present invention result from the embodiments shown in the figures, in which.

DETAILED DESCRIPTION OF THE INVENTION

Figure 1:
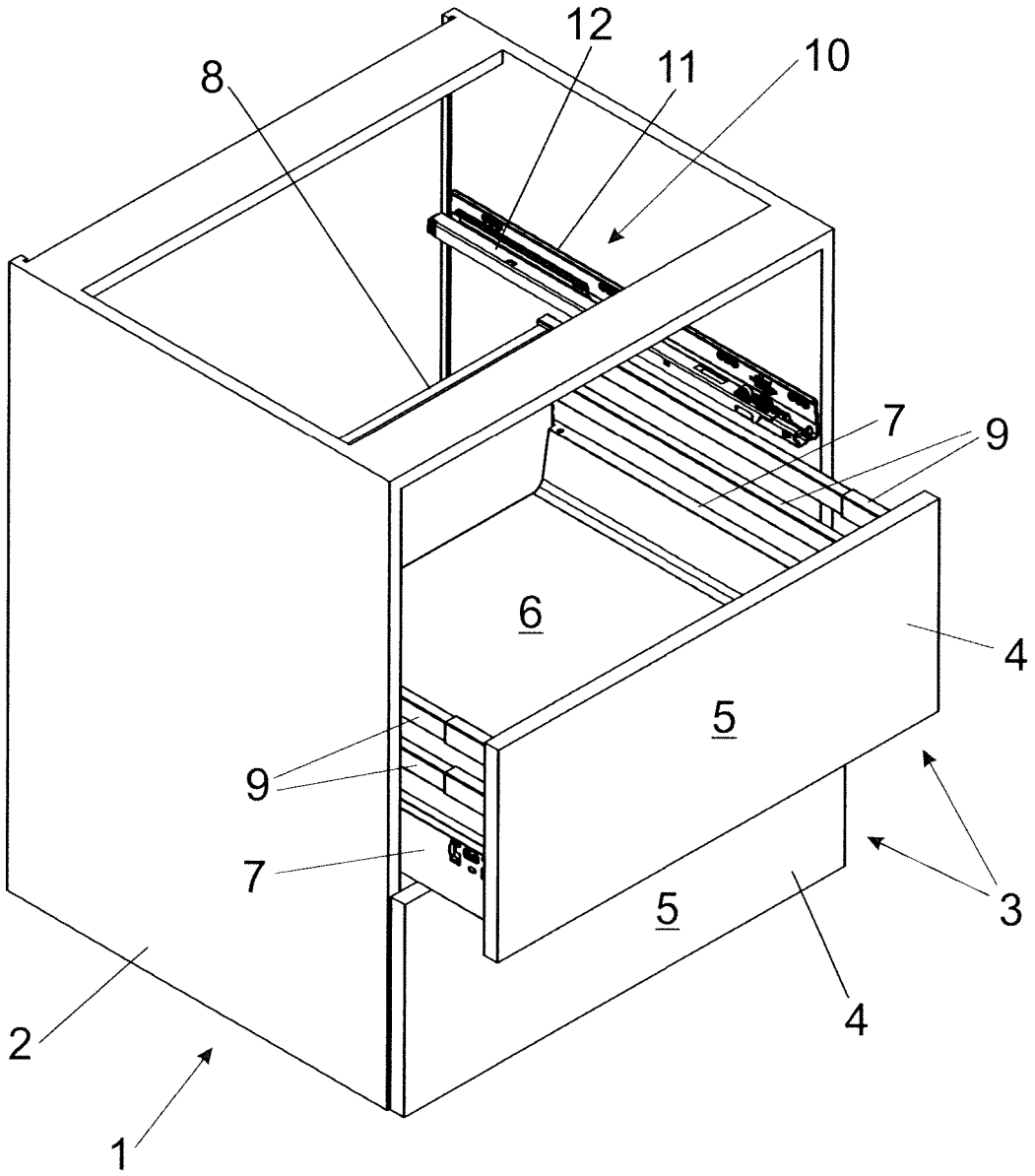
FIG. 1 shows a perspective view of an item of furniture having a furniture carcass and drawers being movable thereto.

FIG. 1 shows an item of furniture 1 with a cupboard-shaped furniture carcass 2 and movably-mounted furniture parts 3 in the form of drawers 4 which are displaceable relative to the furniture carcass 2. The drawers 4 each have a front panel 5, a drawer base 6, side walls 7, and a rear wall 8. Above the side walls 7, struts 9 are provided which extend between the front panel 5 and the rear wall 8 and which are provided for enlarging the accommodating capacity of the drawer 4. For the displaceable support of the drawers 4 relative to the furniture carcass 2, drawer pull-out guides 10 are provided which each have a carcass rail 11 to be fixed to the furniture carcass 2 and at least one extension rail 12 to be connected to the drawer 4, the extension rail 12 is displaceably mounted relative to the stationary carcass rail 11. An additional central rail may be arranged between the carcass rail 11 and the extension rail 12 by which a full extension of the drawer 4 can be obtained. Such a full extension is then provided when the rear wall 8, in the fully extended position of the drawer 4, is substantially flush with the front face of the furniture carcass 2.

Figure 2:
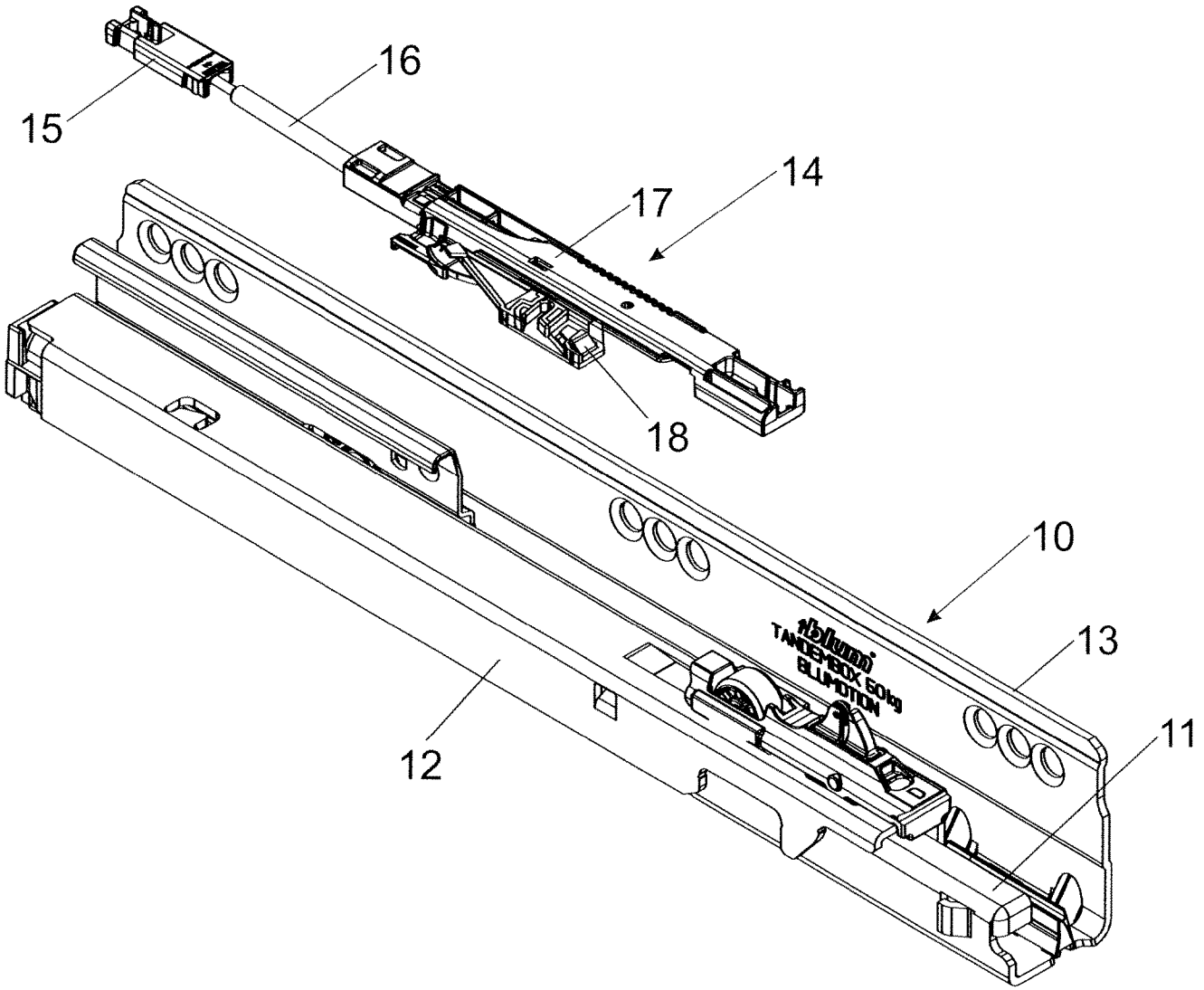
FIG. 2 shows a drawer pull-out guide with a retraction device in a perspective view.

FIG. 2 shows the drawer pull-out guide 10 with the retraction device 14 in a perspective view. By way of the retraction device 14, the displaceably mounted extension rail 12, at the end of the closing movement, can be pulled into the fully closed position by the force of a spring device 16. Usually, the extension rail 12 includes therefore a coupling element (not shown), in particular a peg protruding from the extension rail 12. The coupling element can be coupled to an entrainment member 18 of the retraction device 14, and the entrainment member 18 is displaceably mounted relative to the housing 17 and can be subsequently pulled into the fully closed position by the force of the spring device 16. The housing 17 of the retraction device 14 is preferably fixed to the carcass rail 11 and arranged between an intermediate space formed between the extension rail 12 and the fastening section 13 of the carcass rail 11.

Figure 3:
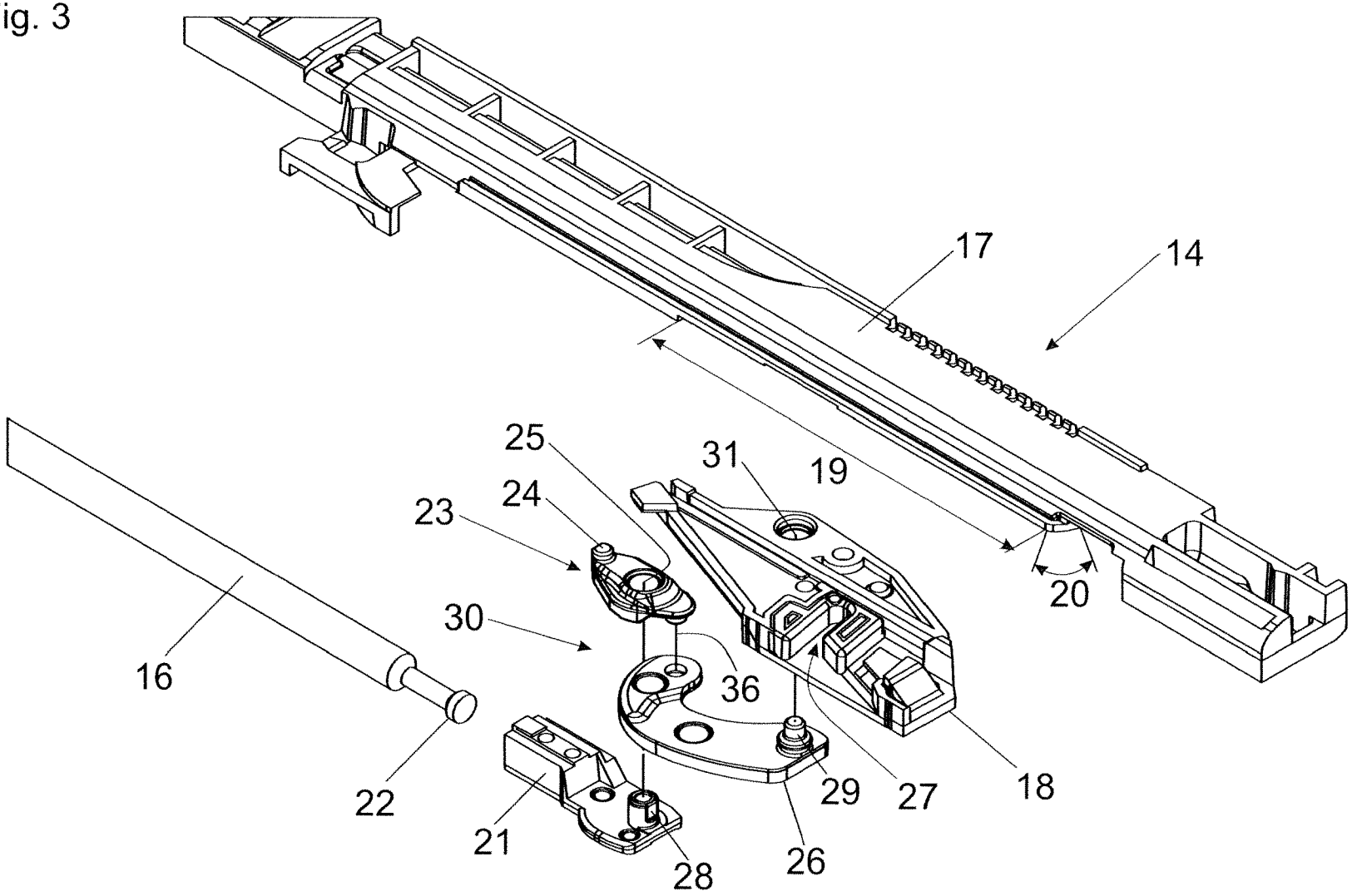
FIG. 3 shows the retraction device in an exploded view seen from above.

FIG. 3 shows the retraction device 14 in a perspective exploded view from above. For the gliding support of an entrainment member 18, a linear displacement path 19 is provided on the housing 17, wherein the linear displacement path 19 is followed by a bent or edged section 20. The entrainment member 18 includes a notch 27 which can be releasably coupled to a coupling element (in particular to a peg) fixed to the extension rail 12. In the fully closed position of the drawer 4, the coupling element is in engagement with the notch 27. When the drawer 4 is manually opened, the entrainment member 18 is pulled along the linear displacement path 19 in an opening direction 35 by the coupling element (FIG. 5*a*-5*d*), whereby the spring device 16 is tensioned. After a predetermined distance, the entrainment member 18 reaches the bent section 20, so that the entrainment member 18 is pivoted, the coupling element of the extension rail 12 is released, and the drawer 4 can be subsequently moved in an uncoupled condition further in the opening direction 35. The entrainment member 18 remains meanwhile within the bent section 20 in a tilted position, i.e. in a pre-stressed, self-locking ready position, and the spring device 16 is in a tensioned condition. Upon closing the drawer 4, the coupling element arranged on the extension rail 12 can again release the entrainment member 18 from the pre-stressed ready position by running into the notch 27, whereupon the entrainment member 18 (and therewith the extension rail 12) can be pulled into the fully closed position by the force of the spring device 16.

For tensioning the spring device 16, a coupling device 30 in the form of a lever transmission is provided by which the required force for tensioning the spring device 16 can be reduced and a sudden, undesired separation of the spring force (i.e. at that moment at which the entrainment member 18 enters into the bent section 20 and thereby releases the drawer 4) and also an unduly large acceleration of the drawer 4 towards the opening direction related therewith can be avoided. The spring device 16 can be tensioned by a spring holder 21 which is separate from the entrainment member 18, and the fastening location 22 of the spring device 16 is connected to the spring holder 21. The spring holder 21 includes a bearing 28 on which a two-armed lever 23 is pivotally mounted about a pivoting axis 25. On a first lever end of the two-armed lever 23 there is arranged at least one guide element 24 which can be displacably guided along a control curve 33 (FIG. 4) of the housing 17. The other (second) lever end of the two-armed lever 23 is connected via a hinged axis 36 to a first end of a preferably curved-shaped transmission lever 26. The other (second) end of the transmission lever 26 is motionally coupled via a pivot bearing 29 to the entrainment member 18, wherein the pivot bearing 29 of the transmission lever 26 engages an opening 31 of the entrainment member 18. The first lever end and the second lever end of the two-armed lever 23 may have a different length, wherein, in terms of force, it is advantageous when the guide element 24 is arranged on the longer lever end of the two-armed lever 23.

Figure 4:
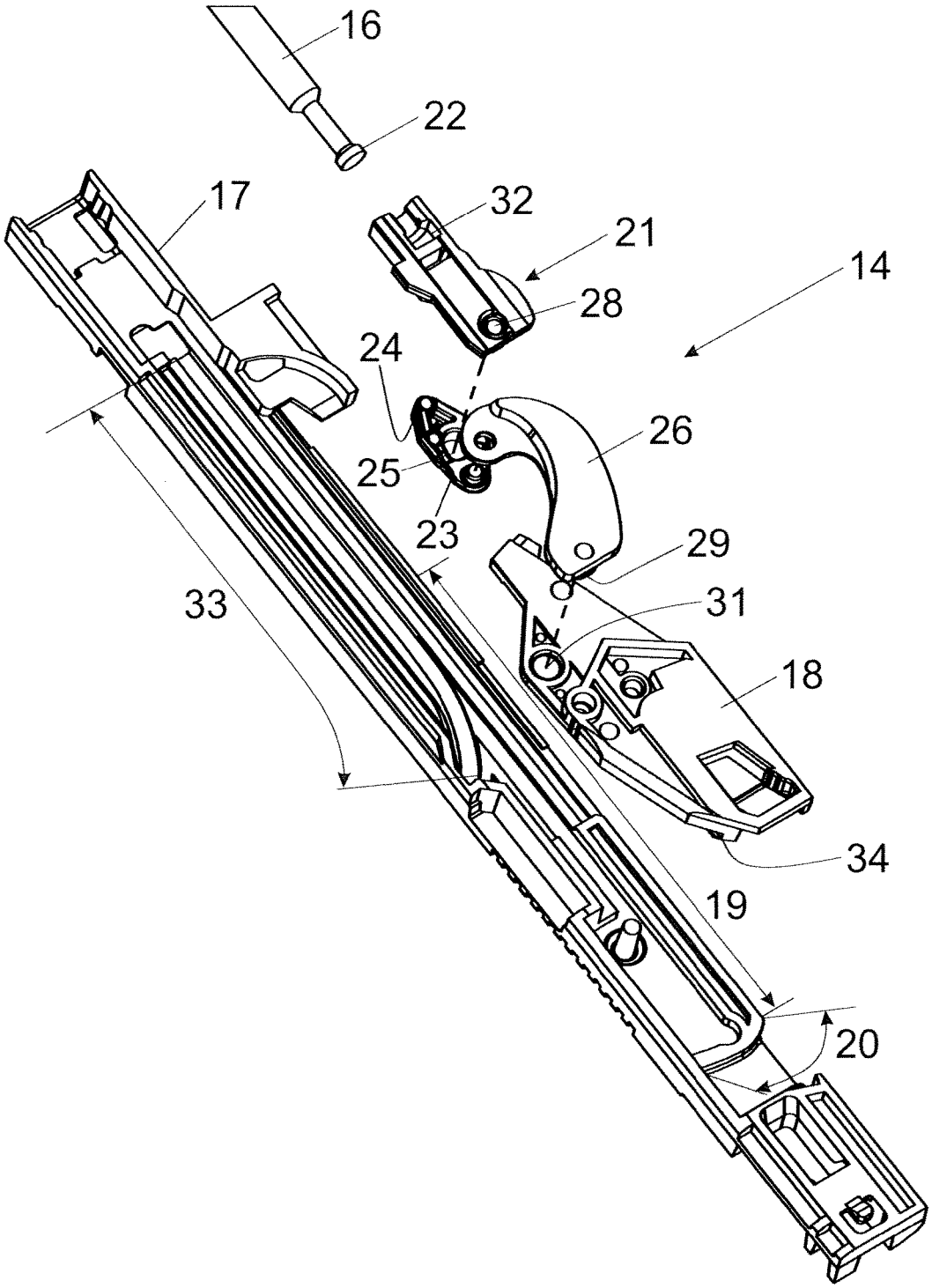
FIG. 4 shows the retraction device in an exploded view seen from below.

FIG. 4 shows the retraction device 14 in an exploded view from below. The fastening location 22 of the spring device 16 can be form-fittingly anchored to the recess 32 of the spring holder 21, the bearing 28 of the spring holder 21 serves for pivotally supporting the two-armed lever 23 about the pivoting axis 25. The other lever end of the two-armed lever 23 is hingedly connected to the entrainment member 18 via the curved-shaped transmission lever 26. For guiding the entrainment member 18, a linear displacement path 19 and a bent section 20 adjoining thereon are arranged or formed on the housing 17 of the retraction device 14. The entrainment member 18 includes a guide device 34 in the form of a protrusion by which the entrainment member 18 can be guided along the linear displacement path 19 and along the bent section 20. Moreover, a control curve 33 separate from the linear displacement path 19 is formed on the housing 17 for displaceably guiding the guide element 24 of the two-armed lever 23. The control curve 33 includes a linearly extending section which is followed by a curved section corresponding to the last tensioning path of the spring device 16. By the co-operation of the two-armed lever 23 with the curved section of the control curve 33, in the last section of the tensioning path of the spring device 16 until the end of the tensioning path, the movement of the fastening location 22 of the spring device 16 on the spring holder 21 falls back (is slower) relative to the moving entrainment member 18. Therefore, in the last portion of the tensioning path of the spring device 16, the movement of the fastening location 22 is slower than the movement of the entrainment member 18. According to an embodiment, the length of the curved section of the control curve 33—relating to the overall length of the control curve 33—is at least a third of the overall length of the control curve 33. By way of the length and form of the control curve 33, the tensioning path as well as the force progression of the tensioning process can be modified in a variety of ways, for example by a provision of a longer control curve 33—in comparison with the linear displacement path 19—the required force for tensioning can be reduced.

Figures 5A, 5B, 5C, 5D:
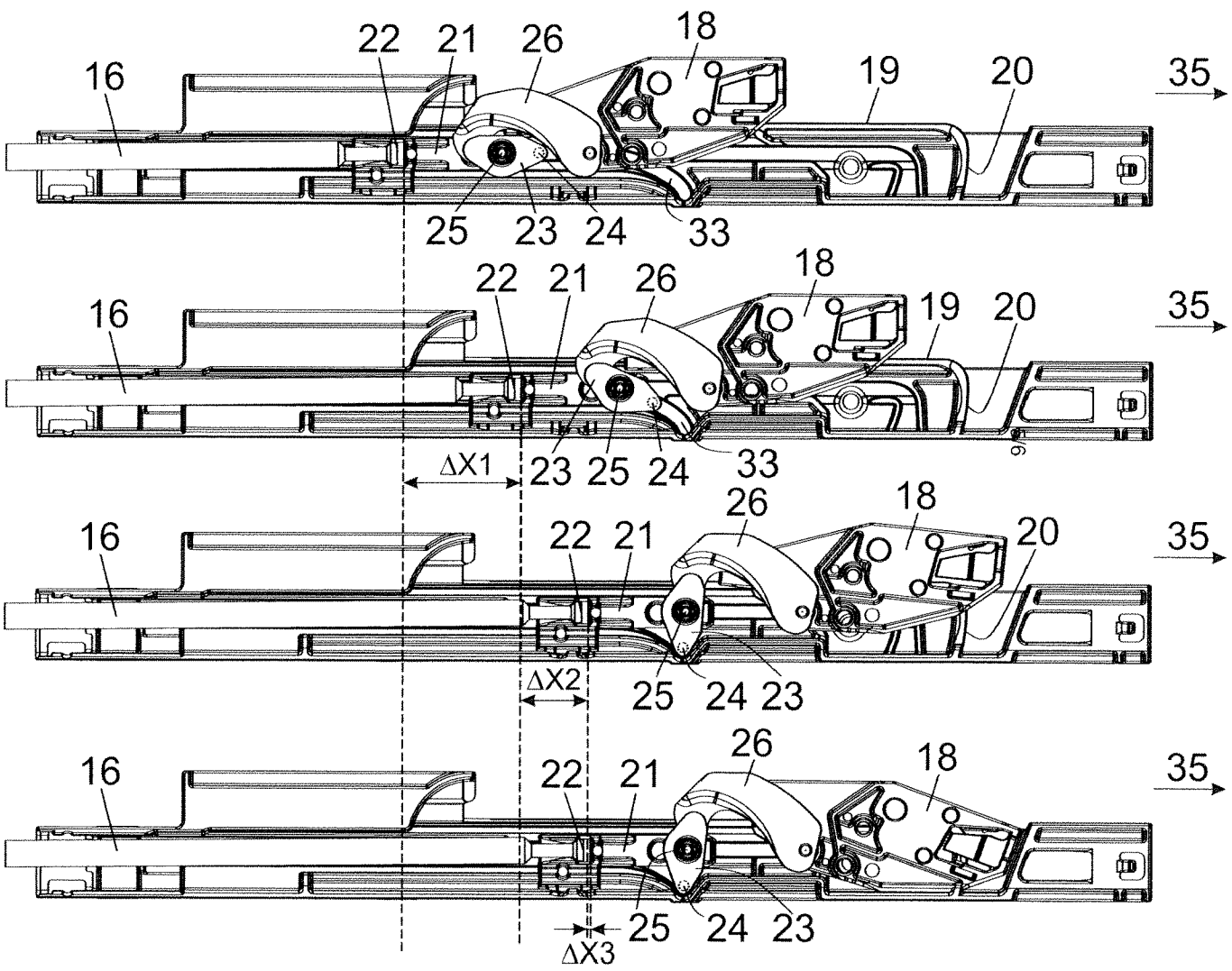
FIG. 5*a*-5*d* show the tensioning process of the spring device in temporal sequences.

FIG. 5*a*-5*d* show the tensioning process of the spring device 16 in temporal sequences. Starting from the fully closed position according to FIG. 5*a*, in which the spring device 16 is substantially relaxed, the entrainment member 18 is pulled along the linear displacement path 19 in the opening direction 35 by applying a manual pulling force to the movable furniture part 3, and so the spring device 16 is tensioned relative to the stationary spring basis 15 (FIG. 2). In the first tensioning section ΔX1 shown in FIG. 5*b*, there are substantially equal movement ratios between the entrainment member 18 and the fastening location 22 of the spring device 16 (i.e., the fastening location 22 moves with the same speed as the entrainment member 18 in the opening direction 35). The two-armed lever 23 which is pivotally arranged on the spring holder 21 is guided by the guide element 24 along the control curve 33. In a second tensioning section ΔX2 and in comparison to the first tensioning section ΔX1 (see FIG. 5*c*), a slower movement of the fastening location 22 relative to the entrainment member 18 can be provided (FIG. 5*b*). By the co-operation of the guide element 24 with the curved section of the control curve 33, the two-armed lever 23 is pivoted in a clockwise direction, so that in a third tensioning section ΔX3 and in comparison to the second tensioning section ΔX2 (see FIG. 5*d*), there is again a slower movement of the fastening location 22 relative to the entrainment member 18 which is further moved in the opening direction 35. In FIG. 5*d*, the entrainment member 18 adopts a tilted, self-locking ready position in which the coupling between the movable furniture part 3 and the entrainment member 18 is released so that the movable furniture part 3 can be further moved in the opening direction 35 in an uncoupled condition.

By way of the tensioning sections ΔX1, ΔX2 and ΔX3, a continuously decelerated movement of the fastening location 22 relative to the entrainment member 18 being moved in the opening direction 35 can be provided, so that the spring device 16 is not tensioned until the maximum spring deflection. Tensioning the spring device 16 therefore requires less effort, and the transition section and load change between the coupled and uncoupled condition of the entrainment member 18 can be significantly harmonized (i.e., the undesired spring separation force and an unduly large acceleration of the movable furniture part 3 upon decoupling the entrainment member 18 from the drawer 4 can be avoided therewith. By way of the reduction ratio effected by the coupling device 30, spring devices 16 with a high spring force can also be tensioned with less effort.

Figure 6A:
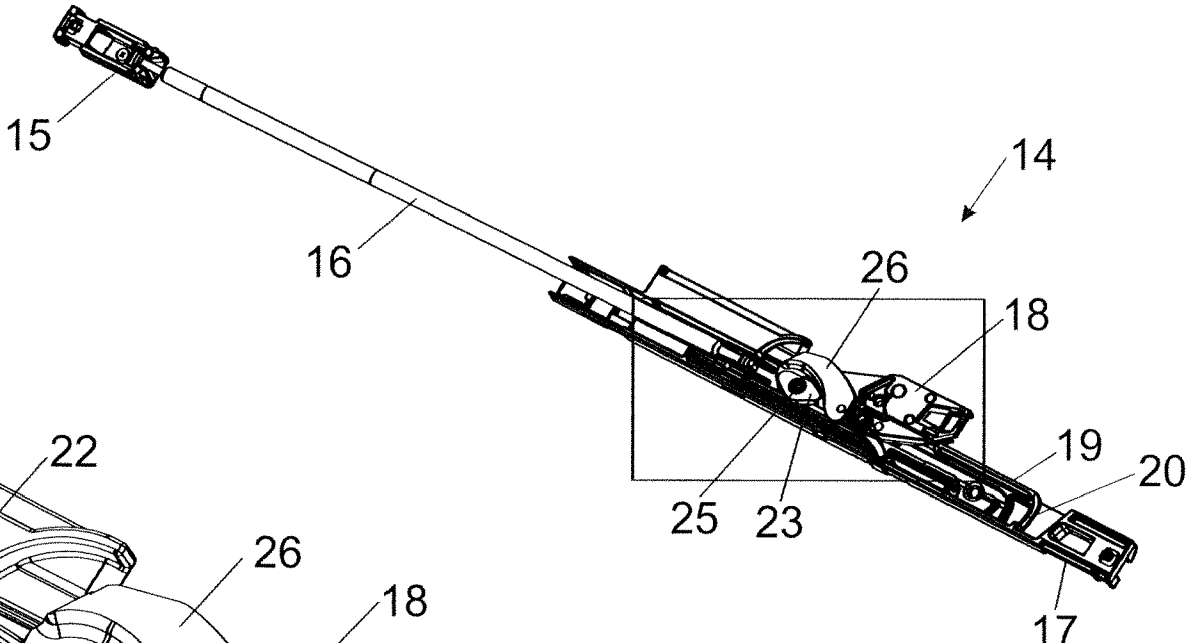
FIG. 6*a*, 6*b* show the retraction device in a perspective view and an enlarged detail view thereof.
Figure 6B:
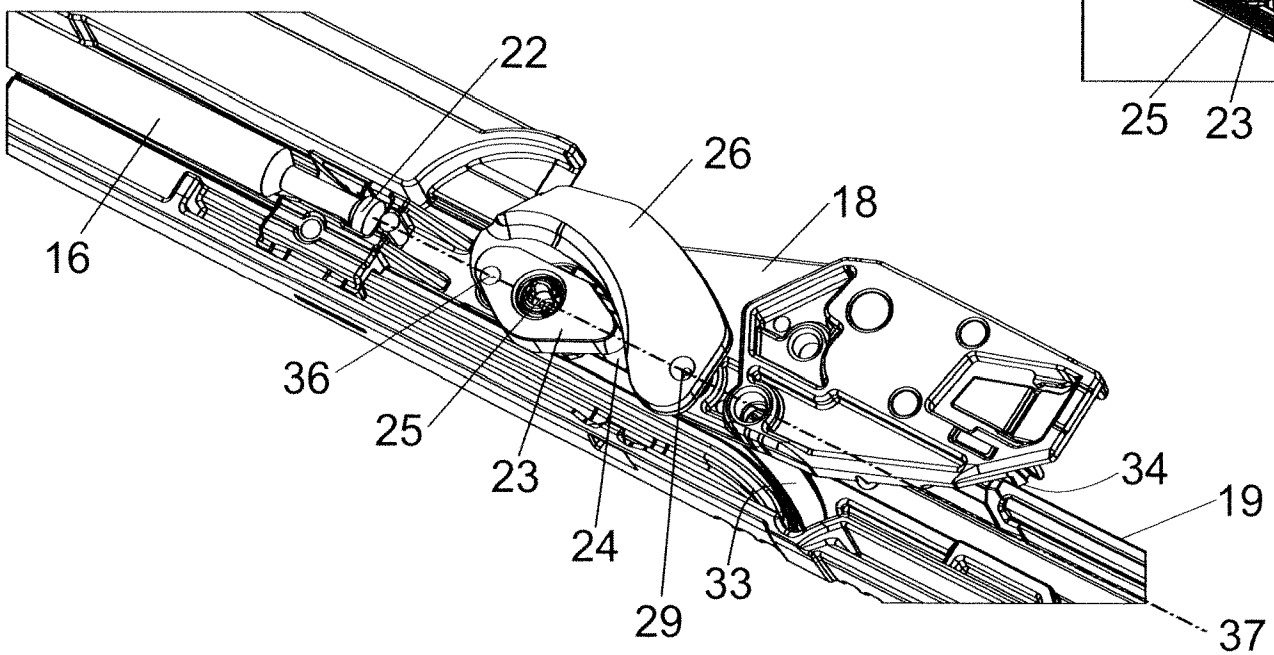

FIG. 6*a* shows the retraction device 14 in a perspective view, in which the spring device 16 can be tensioned relative to the stationary spring basis 15. FIG. 6*b* shows the region framed in FIG. 6*a* in an enlarged view, and the entrainment member 18 is located in a pulled-in end position. The spring device 16 is connected via the fastening location 22 to the displaceable spring holder 21 on which the two-armed lever 23 is pivotally mounted about the pivoting axis 25. The first lever end of the two-armed lever 23 is connected via a hinged axis 36 to a first end of the transmission lever 26, and a second end of the transmission lever 26 is hingedly connected via a pivot bearing 29 to the entrainment member 18. The second lever end of the two-armed lever 23 includes a guide element 24 which is displaceably guided along the control curve 33 upon a movement of the entrainment member 18. It is visible that, in the pulled-in position of the entrainment member 18, the fastening location 22, the hinged axis 36, the pivoting axis 25, and the pivot bearing 29, in a view from above, are aligned along a common line which corresponds to the operating axis 37 of the spring device 16. By way of the aligned arrangement of these components, the frictional forces of the retraction device 14 can be significantly reduced.

The compact construction of the retraction device 14 can also be seen from the fact that, in the pulled-in condition of the entrainment member 18, the transmission lever 26 being curved along the longitudinal direction embraces the two-armed lever 23. It may be further provided that the spring holder 21, the two-armed lever 23, the transmission lever 26, and the entrainment member 18 are spaced from each other and overlap each other, respectively, in a height direction relative to the pivoting axis 25. By way of the nested arrangement of these components, it is possible to enlarge a portion of the entrainment member 18 towards the hinged axis 36, so that in total, an enlarged portion of the entrainment member 18 engages the linear displacement path 19. Thereby, an improved tilt-safe guidance of the entrainment member 18 upon a movement along the linear displacement path 19 can be provided.

For the spring device 16, at least one helical spring may be provided which is preferably in the form of a tension spring. In order to provide a higher spring force, spring assemblies with two or more helical springs switched in parallel may also be used, which, when being tensioned, are equally pulled to the same extent.

The invention claimed is:

1. A retraction device for retracting a movable furniture part into a closed end position relative to a furniture carcass, said retraction device comprising:

an entrainment member releasably coupled to the movable furniture part, the entrainment member being supported displaceably over at least a region of a linear displacement path;

a spring device for applying a force to the entrainment member, the spring device configured to be tensioned by a spring holder separate from the entrainment member;

a coupling device for motionally coupling a movement between the entrainment member and the spring holder, the coupling device being configured to cause an end of the spring device on the spring holder to move slower relative to the entrainment member along a control curve as the entrainment member is being pulled out in an opening direction, wherein the coupling device includes a two-armed lever having two lever ends, the two-armed lever being pivotally mounted about a pivoting axis on the spring holder, a first lever end of the two-armed lever being motionally coupled via a pivotable transmission lever to the entrainment member, and a second lever end of the two-armed lever including a guide element which, upon movement of the entrainment member, is displaceably guided over at least a region of the control curve.

2. The retraction device according to claim 1, wherein the first lever end and the second lever end of the two-armed lever have different lengths.

3. The retraction device according to claim 2, wherein the guide element is arranged on a longer one of the first lever end and the second lever end of the two-armed lever.

4. The retraction device according to claim 1, wherein the transmission lever has a first end pivotably connected to the entrainment member and a second end pivotably connected to the two-armed lever.

5. The retraction device according to claim 4, wherein the transmission lever is curved-shaped.

6. The retraction device according to claim 5, wherein the curved-shaped transmission lever embraces the two-armed lever in a pulled-in position of the entrainment member.

7. The retraction device according to claim 1, wherein the control curve is formed separately from the linear displacement path of the entrainment member.

8. The retraction device according to claim 1, wherein the control curve includes a curved section on an end region which corresponds to a last tensioning path of the spring device.

9. The retraction device according to claim 8, wherein a length of the curved section of the control curve is at least a third of an overall length of the control curve.

10. The retraction device according to claim 1, wherein the retraction device has a housing on which at least one of the linear displacement path and the control curve is arranged or formed.

11. The retraction device according to claim 1, wherein the entrainment member is movably mounted along the linear displacement path between a self-locking ready position, in which the spring device is in a tensioned condition, and an end position, in which the spring device is at least partly in a relaxed condition.

12. A drawer pull-out guide comprising a retraction device according to claim 1.

13. The drawer pull-out guide according to claim 12, wherein the drawer pull-out guide further comprises a carcass rail to be fixed to a furniture carcass and an extension rail displacably mounted relative to the carcass rail, wherein the extension rail can be pulled by the retraction device into the fully closed end position at the end of a closing movement.

14. An arrangement comprising a drawer and a retraction device according to claim 1.

* * * * *